US009708144B2

(12) United States Patent
Jang et al.

(10) Patent No.: US 9,708,144 B2
(45) Date of Patent: Jul. 18, 2017

(54) TELLER CASH RECYCLER

(71) Applicant: NAUTILUS HYOSUNG INC., Seoul (KR)

(72) Inventors: Chul Won Jang, Seoul (KR); Seok Kim, Seoul (KR); Sang Hyun Lee, Incheon (KR); Geon-Hyeok Lim, Anyang-si (KR); Yun Seok Jeong, Suwon-si (KR)

(73) Assignee: NAUTILUS HYOSUNG INC., Seoul (KR)

( * ) Notice: Subject to any disclaimer, the term of this patent is extended or adjusted under 35 U.S.C. 154(b) by 0 days.

(21) Appl. No.: 15/196,208

(22) Filed: Jun. 29, 2016

(65) Prior Publication Data

US 2017/0004666 A1 Jan. 5, 2017

(30) Foreign Application Priority Data

Jul. 3, 2015 (KR) ..... 10-2015-0095028

(51) Int. Cl.
*B65H 5/00* (2006.01)
*B65H 5/06* (2006.01)
(Continued)

(52) U.S. Cl.
CPC ..... *B65H 5/062* (2013.01); *B65H 29/18* (2013.01); *B65H 79/00* (2013.01);
(Continued)

(58) Field of Classification Search
CPC .... B65H 5/062; B65H 79/00; B65H 2402/10; B65H 2402/32; B65H 2402/44;
(Continued)

(56) References Cited

U.S. PATENT DOCUMENTS

2008/0121722 A1* 5/2008 Kadowaki ..... G07D 11/0084 235/480
2013/0075467 A1* 3/2013 Graef ..... G06Q 20/1085 235/379

(Continued)

FOREIGN PATENT DOCUMENTS

EP 2151805 A1 2/2010
KR 10-2009-0093698 A 9/2009

OTHER PUBLICATIONS

Extended European Search Report dated Nov. 30, 2016 issued in corresponding European Patent Application No. 16177482.3.

*Primary Examiner* — Prasad Gokhale
(74) *Attorney, Agent, or Firm* — Bacon & Thomas, PLLC

(57) ABSTRACT

The present disclosure provides a teller cash recycler. The teller cash recycler includes a vault unit configured to store bills; a handling unit, provided at an upper portion of the vault unit, movable to a front side and a rear side of the vault unit, through which bills are deposited and withdrawn; a driving gear unit, provided at a lower portion of the handling unit, including a plurality of driving gears; a driven gear unit, provided at the upper portion of the vault unit, including a plurality of driven gears to which a driving force from the driving gears is transmitted; one or more swing arms, at which at least one of the driven gears is installed, configured to rotate by movement of the handling unit; and an interference unit, provided at the swing arm, configured to apply a rotational moment to the swing arm while being pushed by a handling unit.

9 Claims, 4 Drawing Sheets

(51) Int. Cl.

| | |
|---|---|
| ***B65H 79/00*** | (2006.01) |
| ***G07D 11/00*** | (2006.01) |
| ***G07F 19/00*** | (2006.01) |
| ***B65H 29/18*** | (2006.01) |

(52) U.S. Cl.
CPC ..... *G07D 11/0003* (2013.01); *G07D 11/0012* (2013.01); *G07D 11/0021* (2013.01); *G07D 11/0081* (2013.01); *G07D 11/0096* (2013.01); *G07F 19/20* (2013.01); *G07F 19/202* (2013.01); *G07F 19/203* (2013.01); *G07F 19/205* (2013.01); *B65H 2402/10* (2013.01); *B65H 2402/32* (2013.01); *B65H 2402/441* (2013.01); *B65H 2403/45* (2013.01)

(58) Field of Classification Search
CPC ..... B65H 2402/441; B65H 2403/45; G07D 11/0003; G07D 11/0012; G07D 11/0021; G07D 11/0081; G07D 11/0096; G07F 19/20; G07F 19/205
See application file for complete search history.

(56) References Cited

U.S. PATENT DOCUMENTS

2013/0307210 A1* 11/2013 Takada ..... B65H 5/26 271/3.19
2015/0307306 A1* 10/2015 Kadota ..... G07D 11/00 271/3.19

* cited by examiner

TELLER CASH RECYCLER

TECHNICAL FIELD

The present disclosure relates to a teller cash recycler.

BACKGROUND

An automated teller machine is a device capable of providing financial services such as deposit and withdrawal without help of a bank staff and regardless of time and place.

Recently, in addition to an automated teller machine for customers of financial institutions, a teller cash recycler is introduced to improve efficiency of works in the financial institutions and quickly process settlement or the like after the close of business.

For example, the teller cash recycler may be provided under a desk of a teller and have therein a storage unit for storing bills. A teller can deposit and withdraw bills by manipulating the teller cash recycler and also can count bills in real time.

The teller cash recycler may include a handling unit manipulated by a teller to deposit/withdraw bills, a vault unit for storing bills, a transfer unit for transferring bills, a door for selectively opening/closing the vault unit, and the like. Particularly, a driving gear is provided at a lower portion of the handing unit to receive a driving force of a transfer roller from the handling unit, and a driven gear is provided at an upper portion of the vault unit to receive the driving force while being engaged with the driving gear.

A conventional teller cash recycler has a structure in which the handling unit can slide to a front side of the vault unit. Therefore, when the handling unit slides at an upper portion of the vault unit, the driving gear of the handling unit is interfered with or damaged by the upper portion of the vault unit, or the driven gear of the vault unit is interfered with or damaged by a lower portion of the handing unit. (Patent Document 1) Korean Patent Application Publication No. 10-2009-0093698

SUMMARY

In view of the above, the present disclosure provides a teller cash recycler capable of avoiding interference between a driving gear of a handling unit and a driven gear of a vault unit in the case of sliding the handling unit on the vault unit. the present disclosure provides a teller cash recycler comprising:

- a vault unit configured to store bills;
- a handling unit, provided at an upper portion of the vault unit, movable to a front side and a rear side of the vault unit, through which bills are deposited and withdrawn;
- a driving gear unit, provided at a lower portion of the handling unit, including a plurality of driving gears;
- a driven gear unit, provided at the upper portion of the vault unit, including a plurality of driven gears to which a driving force from the driving gears is transmitted;
- one or more swing arms, at which at least one of the driven gears is installed, configured to rotate by movement of the handling unit; and
- an interference unit, provided at the swing arm, configured to apply a rotational moment to the swing arm while being pushed by a part of the handling unit.

Further, the present disclosure also provides the teller cash recycler wherein the swing arm has a first state in which the driven gear is in contact with the driving gear and thus a driving force from the driving gear is transmitted to the driven gear and a second state in which the contact between the driven gear and the driving gear is released. Further, the present disclosure also provides the teller cash recycler wherein the interference unit is fixed to an end portion of the swing arm via the driven gear and includes a stopper having an outer diameter greater than an outer diameter of the driven gear in order to avoid collision between the driven gear and the handling unit.

Further, the present disclosure also provides the teller cash recycler wherein the swing arm rotates to the first state or the second state by an elastic spring when the handling unit moves to a front side or a rear side of the vault unit.

Further, the present disclosure also provides the teller cash recycler wherein the driving gear and the driven gear are configured as helical gears having twisted threads to be engaged with each other.

Further, the present disclosure also provides the teller cash recycler wherein the driving gears are provided at different heights at a lower portion of the driving gear unit.

Further, the present disclosure also provides the teller cash recycler wherein the driving gears include: a first driving gear projecting from the lower portion of the handling unit; and one or more second driving gears, projecting from the lower portion of the handling unit by a height smaller than a height of the first driving gear, of which positions are close to a front side of the vault unit compared to a position of the first driving gear.

Further, the present disclosure also provides the teller cash recycler wherein the driven gear includes: a first driven gear to which a driving force from the first driving gear is transmitted; and one or more second driven gears, installed at the swing arm, to which a driving force from the second driving gear is transmitted.

Further, the present disclosure also provides the teller cash recycler wherein the handling unit has a retreating groove into which the interference unit is inserted when the driving force is transmitted from the driving gears to the driven gears.

The above-described embodiments are advantageous in that it is possible to avoid the interference between the driving gear of the handling unit and the driven gear of the vault unit because the driven gear of the vault unit retreats downward when the handling unit slides on the vault unit.

Further, the above-described embodiments are advantageous in that a thrust generated by rotation of the driven gear configured as a helical gear can be cancelled by the interference unit provided at the front side of the driven gear where the thrust is generated.

BRIEF DESCRIPTION OF THE DRAWINGS

The objects and features of the present disclosure will become apparent from the following description of embodiments, given in conjunction with the accompanying drawings, in which.

DETAILED DESCRIPTION OF THE EMBODIMENTS

Figure 1:
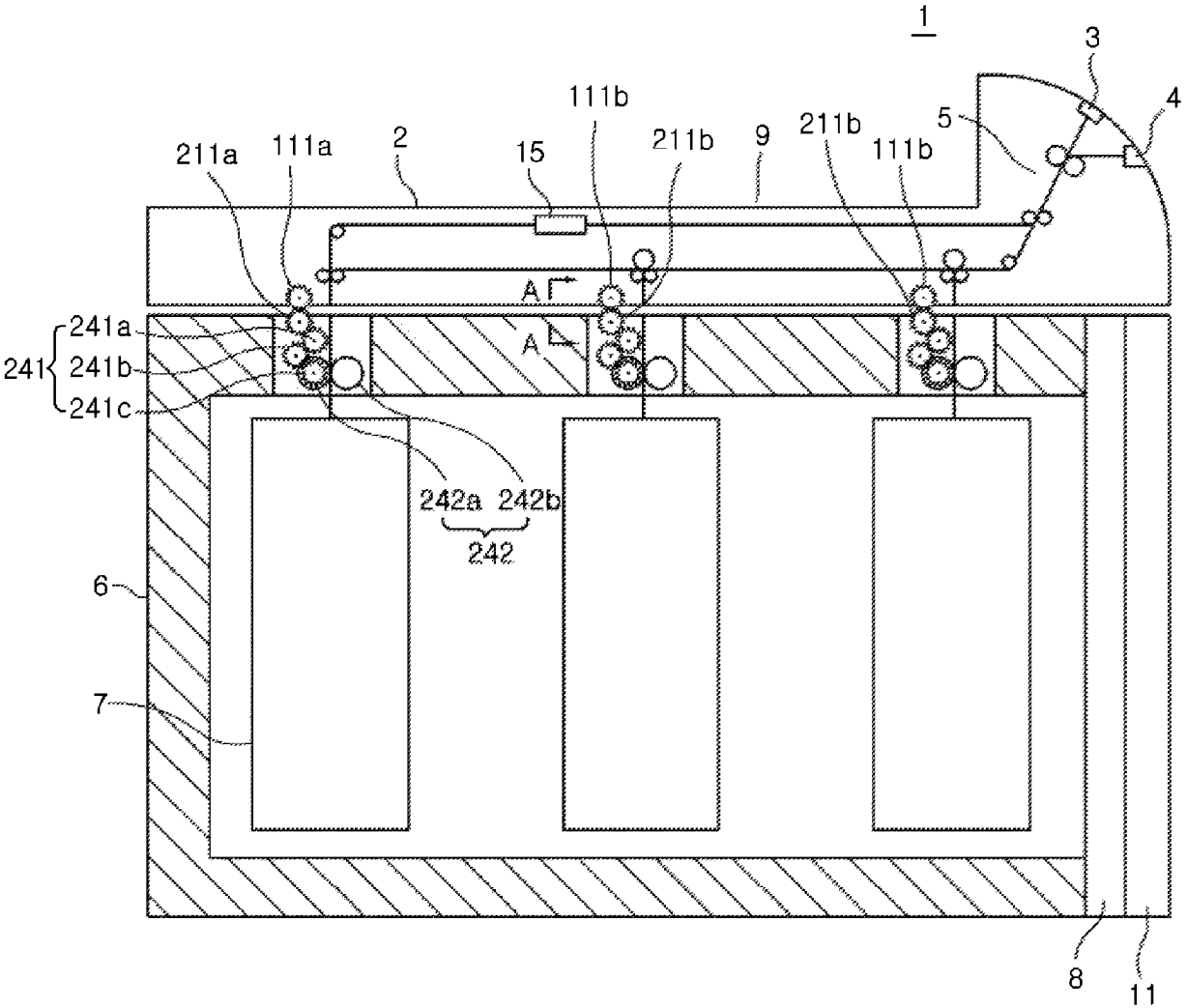
FIG. 1 is a schematic side view of a teller cash recycler according to an embodiment.

Hereinafter, configurations and operations of embodiments will be described in detail with reference to the accompanying drawings. The following description is one of various patentable aspects of the disclosure and may form a part of the detailed description of the disclosure. However, in describing the disclosure, detailed descriptions of known configurations or functions that make the disclosure obscure may be omitted.

The disclosure may be variously modified and may include various embodiments. Specific embodiments will be exemplarily illustrated in the drawings and described in the detailed description of the embodiments. However, it should be understood that they are not intended to limit the disclosure to specific embodiments but rather to cover all modifications, similarities, and alternatives which are included in the spirit and scope of the disclosure.

The terms used herein, including ordinal numbers such as "first" and "second" may be used to describe, and not to limit, various components. The terms simply distinguish the components from one another. When it is said that a component is "connected" or "linked" to another component, it should be understood that the former component may be directly connected or linked to the latter component or a third component may be interposed between the two components. Specific terms used in the present application are used simply to describe specific embodiments without limiting the disclosure. An expression used in the singular encompasses the expression of the plural, unless it has a clearly different meaning in the context.

Hereinafter, embodiments will be described in detail with reference to the accompanying drawings.

Figure 2:
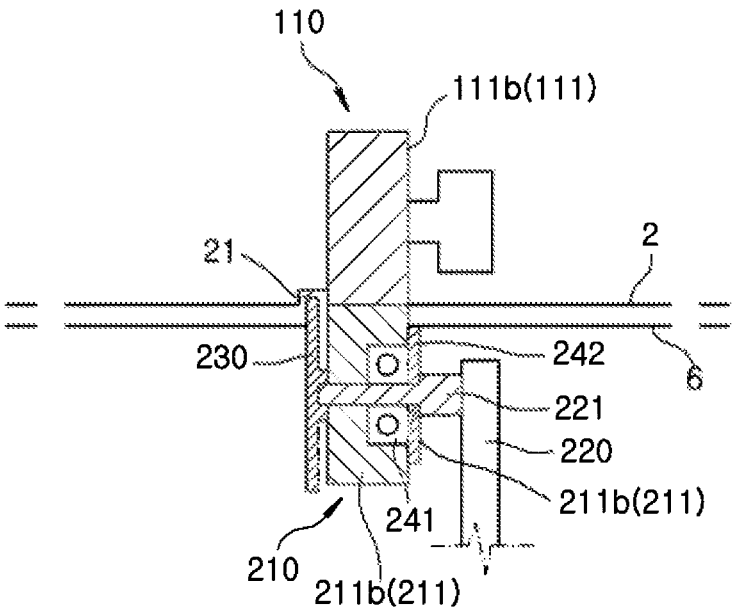
FIG. 2 is a cross sectional view showing a state in which a driving gear and a driven gear are engaged with each other which is taken along a line "A-A" of FIG. 1.
Figure 3:
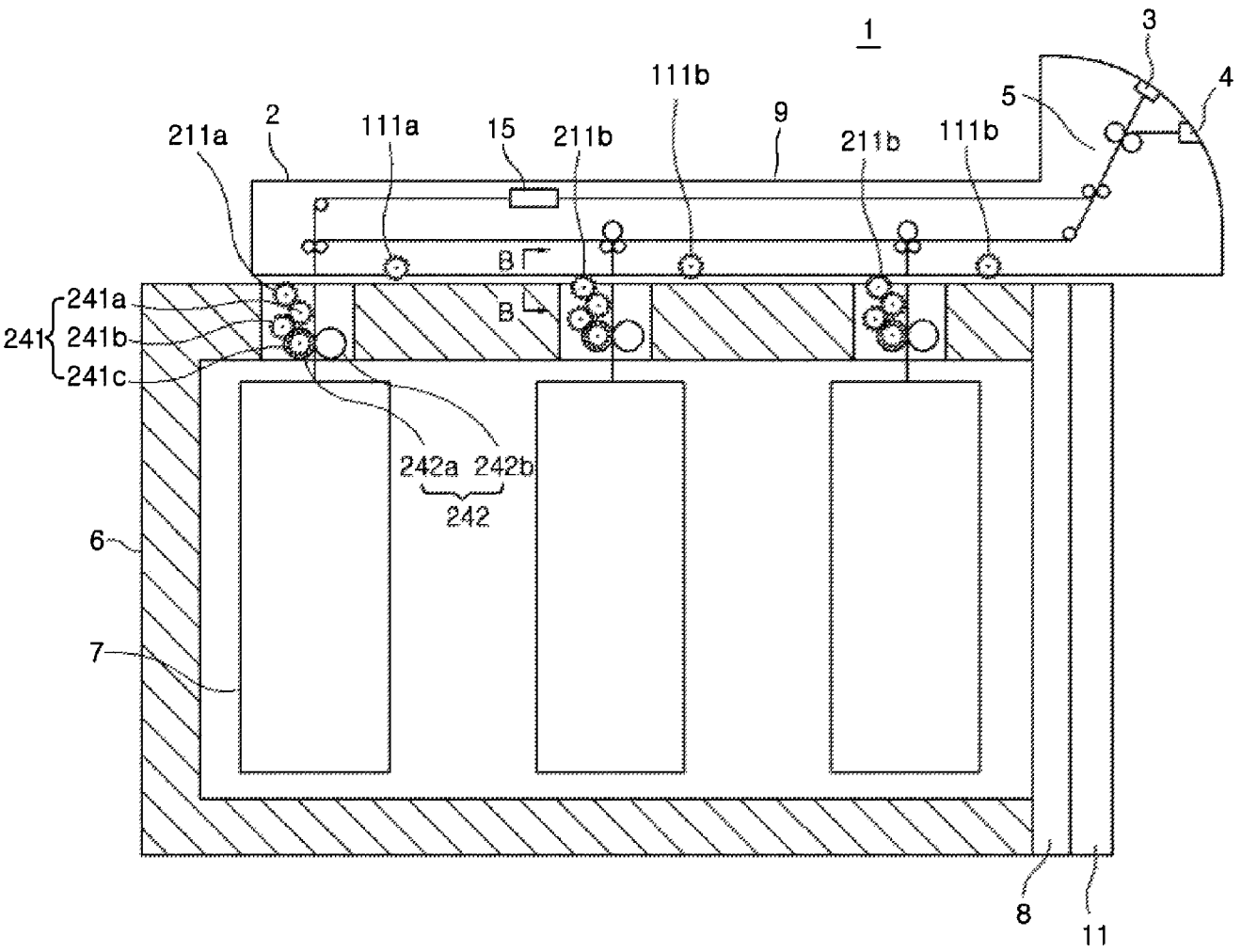
FIG. 3 shows a state in which a handling unit of the teller cash recycler according to the embodiment has been slid.
Figure 4:
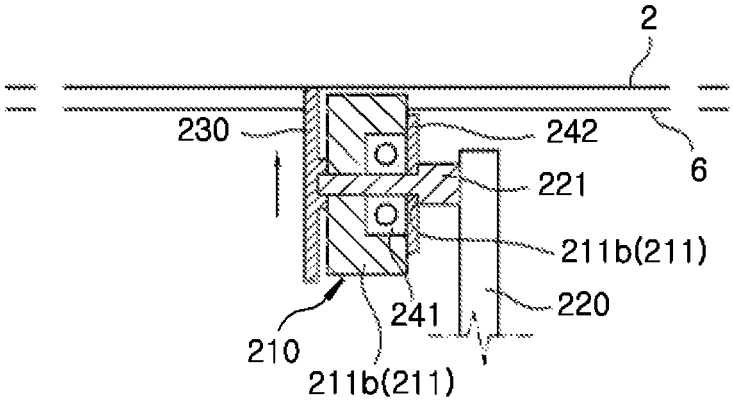
FIG. 4 is a cross sectional view showing a state in which the handling unit and the driven gear are in contact with each other which is taken along a line "B-B" of FIG. 2.

FIG. 1 is a schematic side view of a teller cash recycler according to an embodiment. FIG. 2 is a cross sectional view showing a state in which a driving gear and a driven gear are engaged with each other which is taken along a line "A-A" of FIG. 1. FIG. 3 shows a state in which a handling unit of the teller cash recycler according to the embodiment has been slid. FIG. 4 is a cross sectional view showing a state in which the handling unit and the driven gear are in contact with each other which is taken along a line "B-B" of FIG. 2.

As shown in FIGS. 1 to 4, a teller cash recycler according to an embodiment may include a handling unit 2, a vault unit 6, a door 8, a transfer unit 9, a driving gear unit 110, a driven gear unit 210, a swing arm 220, and an interference unit 230. In FIG. 1, the X-direction may indicate a front side of the teller cash recycler or an outer side of the door, and the Y-direction may indicate a vertical direction of the teller cash recycler.

Specifically, the handling unit 2 may be a portion manipulated by a user to deposit, withdraw and count bills. The handling unit 2 may be provided at an upper portion of the teller cash recycler 1 for user's convenience. Further, the handling unit 2 may be designed to be relatively moved with respect to the vault unit 6 (e.g., designed to be provided with a guide rail and a roller) and thus can slide and project toward the front side of the vault unit 6.

The handling unit 2 may include a deposit unit 3 for depositing bills into the teller cash recycler 1, a withdrawal unit 4 for withdrawing bills to the outside of the teller cash recycler 1, a deposit/withdrawal transfer unit 5 for transferring bills that have been deposited or will be withdrawn, and a bill identifying unit 15 for identifying abnormal bills. The deposit/withdrawal transfer unit 5 may connect the deposit unit 3 and the withdrawal unit 4 with a transfer unit 9 to be described later.

The vault unit 6 provides a space where bills are stored and can protect the stored bills from external access. The vault unit 6 may have therein one or more storage units 7. The bills may be sorted and stored in the storage units by transfer rollers 242. The storage units 7 may be portions partitioned by a plate-shaped member in an inner space of the vault unit 6. Further, the storage units 7 may be configured as additional cassettes into/from the bills can be inserted/taken out.

The door 8 can be provided at the front side of the vault unit 6 to selectively open and close the vault unit 6. A cover 11 may be provided at an outer side of the door 8. The cover 11 can cover the door 8 for beauty and security of the teller cash recycler 1. In a state shown in FIG. 1, the cover 11 can be joined to the handling unit 2, the vault unit 6 or the door 8 by a joint (not shown).

The transfer unit 9 can transfer bills between the handling unit 2 and the storage units 7 of the vault unit 6. To do so, the transfer unit 9 may have a plurality of roller and transfer paths. In general, the transfer unit 9 may be provided between the handling unit 2 and the storage unit 7. However, in the disclosure, the position of the transfer unit 9 is not particularly limited.

The driving gear unit 110 may include a plurality of driving gears 111 for transmitting a driving force provided by a driving unit in the handling unit 2 to the driven gear unit 210. For example, the driving gear unit 110 may include a first driving gear 111*a* projecting from a lower portion of the handling unit 2 by a predetermined height and a second driving gear 111*b* projecting from the lower portion of the handling unit 2 by a height smaller than that of the first driving gear 111*a*.

The first and the second driving gear 111*a* and 111*b* can be engaged with a first and a second driven gear 211*a* and 211*b* of the driven gear unit 210, respectively. The first and the second driving gear 111*a* and 111*b* and the first and the second driven gear 211*a* and 211*b* may have the same shape, the same size and the same dimension. For example, the first and the second driving gear 111*a* and 111*b* and the first and the second driven gear 211*a* and 211*b* may be configured as helical gears having threads that can be engaged with each other.

In the present embodiment, the helical gears are used as the first and the second driving gear 111*a* and 111*b* and the first and the second driven gear 211*a* and 211*b*. However, various gears that transfer the driving force of the driving device in the handling unit 2 to the transfer roller 242 of the vault unit 6 or the like may also be used as the first and the second driving gear 111*a* and 111*b* and the first and the second driven gear 211*a* and 211*b*. For example, the driving gears and the driven gears may be configured as spur gears that transmit the driving force while being connected to two shafts parallel to each other.

The driving gear unit 110 includes a single first driving gear 111*a* and two second driving gears 111*b* of which positions are close to the front side of the vault unit 6 compared to the position of the first driving gear 111*a*. However, the number and the position of the first and the second driving gear 111*a* and 111*b* may vary depending on the design environment of the teller cash recycler.

The first and the second driving gear 111*a* and 111*b* protect from the lower portion of the handling unit 2 by different heights. However, the first and the second driving gear 111*a* and 111*b* may project downward by the same height from the lower portion of the handling unit 2 or may be inserted upward from the lower portion of the handling unit 2.

The driven gear unit 210 may have a plurality of driven gears 211 that can be engaged with the driving gears 111 of the driving gear unit 110 at the upper portion of the vault unit 6. For example, the driven gear unit 210 may include the first driven gear 211*a* to which the driving force from the first driving gear 111*a* is transmitted, and a second driven gear 211*b* to which the driving force from the second driving gear 111*b* is transmitted.

The first driven gear 211*a* may be configured as a single helical gear that projects from the upper portion of the vault unit 6 by a predetermined height. The second driven gear 211*b* may be configured as two helical gears projecting from the upper portion of the vault unit 6 by a height greater than that of the first driving gear 111*a*. As described above, the first and the second driven gear 211*a* and 211*b* may be configured as spur gears other than helical gears.

Particularly, each of the second driven gears 211*b* can be rotatably attached to a swing shaft 221 of the swing arm 220 via a bearing 241 and a support ring 242 and can rotate at the upper portion of the vault unit 6 by the rotation of the swing arm 220. At this time, the swing arm 220 can rotate the second driven gear 211*b* to the position above the vault unit 6 by an upward elastic force of an elastic spring (not shown). In the present embodiment, the swing arm 220 is installed at the second driven gear 211*b*. However, the swing arm 220 may be applied to any driven gear that needs to be rotated.

The driven gear unit 210 can provide the driving force transmitted from the driving gear unit 110 to the transfer roller 242 in the vault unit 6 via a plurality of driving force transmission gears 241. The driving force transmission gears 241 may include a first transmission gear 241*a* engaged with the driven gear 211, a third transmission gear 241*c* connected to a rotation shaft of the transfer roller 242, and a second transmission gear 241*b* engaged with the first and the third transmission gear 241*a* and 241*c*. The transfer roller 242 may include a first transfer roller 242*a* having the same rotation axis as that of the third transmission gear 241*c*, and a second transfer roller 242*b* positioned to face the first transfer roller 242*a*.

Therefore, when the driving force from the driving gear 111 of the driving gear unit 110 is transmitted to the driven gear 211 of the driven gear unit 210, the driving force transmitted to the driven gear 211 can be transmitted to the transfer roller 242 via the first transmission gear 241*a*, the second transmission gear 241*b* and the third transmission gear 241*c*. The swing arm 220 can rotate the driven gear 211 upward by using an elastic spring (not shown). At this time, the rotation angle of the swing arm 220 may be set to range from about 30° to 45°.

For example, the swing arm 220 may have a first state in which the swing arm 220 rotates at an angle of about 30° by the contact between the driven gear 211 and the driving gear 111 and thus the driving force from the driving gear 111 can be transmitted to the driven gear 211 and a second state in which the swing arm 211 rotates at an angle of about 45° by the contact with the lower portion of the handling unit 2 and thus the contact between the driven gear 211 and the driving gear 111 is released. In other words, the swing arm 220 can rotate to the first state or the second state by the elastic spring when the handling unit 2 is moved to the front side or the rear side of the vault unit 6.

The interference unit 230 is pushed by a part of the handling unit 2 or by one or more driving gears 111 of the driving gear unit 110 and thus can provide a rotational moment to the swing arm 220. The interference unit 230 is fixed to the end portion of the swing arm 220 and more specifically to the end portion of a swing shaft 221 of the swing arm 220 via the driven gear 211. Therefore, it is possible to cancel the thrust of the driven gear 211 which is generated when the driven gear 211 configured as a helical gear rotates.

The interference unit 230 may be configured as a ring-shaped stopper and has an outer diameter greater than that of the driven gear 211. At this time, a retreating groove into which the interference unit is inserted when the driving force is transmitted from the driving gear 111 to the driven gear 211 may be formed at the lower portion of the handling unit 2.

Accordingly, when the handling unit 2 slides to the front side or the rear side of the vault unit 6, the outer diameter of the interference unit 230 is brought into contact with a bottom frame of the handling unit 2, which makes it possible to avoid the collision between the driven gear 211 and the handling unit 2. Further, the interference unit 230 is inserted into the retreating groove 21 of the handling unit 2 when the driving force is transmitted from the driving gear 111 to the driven gear 211. Therefore, the driving force can be efficiently transmitted between the driven gear 211 and the driving gear 111. Particularly, when the driving force is transmitted from the driving gear 111 to the driven gear 211, jam may occur at the transfer roller in the vault unit 8 due to the bills that are being transferred. Since the state in which the interference unit 230 is inserted into the retreating groove 21 is maintained at this time, it is possible to prevent the driven gear 211 from being separated by a torque generated by the jam.

Hereinafter, an operation of the teller cash recycler having the above-described functions will be described.

As shown in FIGS. 1 and 2, the first and the second driving gear 111*a* and 111*b* of the driving gear unit 110 can be engaged with the first and the second driven gear 211*a* and 211*b* of the driven gear unit 210 in order to transfer the driving force provided by the driving unit in the handling unit 2 to the driven gear 211.

At this time, the state in which the swing arm 220 rotates the driven gear 211 upward by using the elastic spring is maintained. Therefore, the first and the second driven gear 211*a* and 211*b* can be firmly engaged with the first and the second driving gear 111*a* and 111*a*, respectively. Further, the driving force provided by the driving gear unit 110 can be transmitted to the transfer roller 242 in the vault unit 6 via a plurality of driving force transmission gears 241.

As can be seen from FIGS. 3 and 4, when the handling unit 2 slides on the vault unit 6 to the front side of the vault unit 6, the outer diameter of the interference unit 230 is brought into contact with the bottom frame of the handling unit 2 by the rotation of the swing arm 220 and, thus, the collision between the driven gear 211 and the handling unit 2 can be avoided.

As described above, the embodiment of the disclosure is advantageous in that the interference between the driving gear of the handling unit and the driven gear of the vault unit can be avoided because the driven gear of the vault unit retreats downward when the handling unit slides on the vault unit and also in that the thrust generated when the driven gear configured as a helical gear rotates can be cancelled by the interference unit provided at the front side of the driven gear where the thrust is generated.

While the disclosure has been described in detail with respect to the embodiments, the scope of the disclosure is not limited to specific embodiments and should be interpreted by the accompanying drawings. Further, it is apparent that those skilled in the art may practice various modifications and applications without departing from the scope of the disclosure.

What is claimed is:

1. A teller cash recycler comprising:

a vault unit configured to store bills;

a handling unit, provided at an upper portion of the vault unit, movable to a front side and a rear side of the vault unit, through which bills are deposited and withdrawn;

a driving gear unit, provided at a lower portion of the handling unit, including a plurality of driving gears;

a driven gear unit, provided at the upper portion of the vault unit, including a plurality of driven gears to which a driving force from the driving gears is transmitted;

a swing arm, at which at least one of the driven gears is installed, configured to rotate by movement of the handling unit; and an interference unit, provided at the swing arm, configured to apply a rotational moment to the swing arm while being pushed by a part of the handling unit.

2. The teller cash recycler of claim 1, wherein the swing arm has a first state in which the driven gear is in contact with the driving gear and thus a driving force from the driving gear is transmitted to the driven gear and a second state in which the contact between the driven gear and the driving gear is released.

3. The teller cash recycler of claim 1, wherein the interference unit is fixed to an end portion of the swing arm via the driven gear and includes a stopper having an outer diameter greater than an outer diameter of the driven gear in order to avoid collision between the driven gear and the handling unit.

4. The teller cash recycler of claim 2, wherein the swing arm rotates to the first state or the second state by an elastic spring when the handling unit moves to a front side or a rear side of the vault unit.

5. The teller cash recycler of claim 3, wherein the driving gear and the driven gear are configured as helical gears having twisted threads to be engaged with each other.

6. The teller cash recycler of claim 1, wherein the driving gears are provided at different heights at a lower portion of the driving gear unit.

7. The teller cash recycler of claim 6, wherein the driving gears include:

a first driving gear projecting from the lower portion of the handling unit; and one or more second driving gears, projecting from the lower portion of the handling unit by a height smaller than a height of the first driving gear, of which positions are close to a front side of the vault unit compared to a position of the first driving gear.

8. The teller cash recycler of claim 7, wherein the driven gear includes:

a first driven gear to which a driving force from the first driving gear is transmitted; and one or more second driven gears, installed at the swing arm, to which a driving force from the second driving gear is transmitted.

9. The teller cash recycler of claim 1, wherein the handling unit has a retreating groove into which the interference unit is inserted when the driving force is transmitted from the driving gears to the driven gears.

* * * * *